US008925257B2

(12) United States Patent
Petrello et al.

(10) Patent No.: US 8,925,257 B2
(45) Date of Patent: Jan. 6, 2015

(54) SELF-ELEVATING MAST EMPLOYING DRIVE CARRIAGE

(71) Applicant: Nabors Drilling International Limited, Hamilton (BM)

(72) Inventors: Anthony Petrello, Houston, TX (US); Padira Reddy, Richmond, TX (US); Ashish Gupta, Houston, TX (US); Sean M. Bailey, Willis, TX (US)

(73) Assignee: Nabors Drilling International Limited, Hamilton (BM)

( * ) Notice: Subject to any disclaimer, the term of this patent is extended or adjusted under 35 U.S.C. 154(b) by 23 days.

(21) Appl. No.: 13/799,279

(22) Filed: Mar. 13, 2013

(65) Prior Publication Data

US 2014/0262519 A1 Sep. 18, 2014

(51) Int. Cl.
*E04H 12/34* (2006.01)
*E21B 15/00* (2006.01)

(52) U.S. Cl.
CPC ..... *E21B 15/00* (2013.01)
USPC ..... 52/123.1; 52/111; 52/745.03; 52/745.17

(58) Field of Classification Search
USPC ..... 52/111, 115, 118, 121, 123.1, 745.03, 52/745.17
See application file for complete search history.

(56) References Cited

U.S. PATENT DOCUMENTS

| | | | | |
|---|---|---|---|---|
| 3,185,265 | A * | 5/1965 | White | 52/111 |
| 3,828,513 | A * | 8/1974 | Vanderklaauw | 52/745.04 |
| 5,247,776 | A * | 9/1993 | Tamayo | 52/745.17 |
| 5,423,158 | A * | 6/1995 | Vora | 52/745.17 |
| 5,450,695 | A * | 9/1995 | Desai | 52/118 |
| 5,490,364 | A * | 2/1996 | Desai et al. | 52/637 |
| 6,250,426 | B1 * | 6/2001 | Lombard | 182/146 |
| 6,523,647 | B2 * | 2/2003 | Duplessis | 187/270 |
| 7,337,738 | B2 * | 3/2008 | Hu | 114/90 |
| 8,353,132 | B1 * | 1/2013 | Vogt et al. | 52/123.1 |
| 8,353,141 | B2 * | 1/2013 | Berg | 52/745.04 |
| 8,646,240 | B1 * | 2/2014 | Patrick et al. | 52/651.05 |
| 2002/0170784 | A1 * | 11/2002 | Duplessis | 187/270 |
| 2003/0172599 | A1 * | 9/2003 | Frink | 52/116 |
| 2007/0240622 | A1 * | 10/2007 | Hu | 114/90 |
| 2010/0193247 | A1 * | 8/2010 | Riddle et al. | 175/57 |
| 2013/0305632 | A1 * | 11/2013 | Rivera et al. | 52/117 |

* cited by examiner

*Primary Examiner* — Basil Katcheves
*Assistant Examiner* — Joshua Ihezie
(74) *Attorney, Agent, or Firm* — Haynes & Boone, LLP

(57) ABSTRACT

A method includes attaching a carriage support to a platform, the platform comprising a platform floor having an opening therein, with the carriage support located proximate the opening, attaching a drive carriage to the carriage support, and operably coupling to the drive carriage a first mast section of a mast comprising a plurality of mast sections, and wherein the first mast section is located above the opening. The method also includes arranging a second mast section below the first mast section, lowering, using the drive carriage, the first mast section through the opening, attaching the first mast section to the second mast section, and raising, using the drive carriage, the first mast section and the second mast section through the opening.

15 Claims, 18 Drawing Sheets

SELF-ELEVATING MAST EMPLOYING DRIVE CARRIAGE

TECHNICAL FIELD

The present disclosure relates in general to drilling rigs, and in particular, to assembling a drilling rig using a self-elevating substructure, rig floor, and mast.

BACKGROUND OF THE DISCLOSURE

While various equipment is used in exploration and production operations, such as for oil and gas, accidents sometimes occur with existing drilling rig equipment and operations are otherwise inefficient when numerous personnel are required. Thus, there is a need for improved drilling rig equipment as further disclosed herein.

BRIEF DESCRIPTION OF THE DRAWINGS

The present disclosure is best understood from the following detailed description when read with the accompanying figures. It is emphasized that, in accordance with the standard practice in the industry, various features are not drawn to scale. In fact, the dimensions of the various features may be arbitrarily increased or reduced for clarity of discussion.

FIGS. 3-5A are views similar to that of FIG. 1, but depict the apparatus of FIG. 1 in different operational modes, according to one or more aspects of the present disclosure.

DETAILED DESCRIPTION

Figure 1:
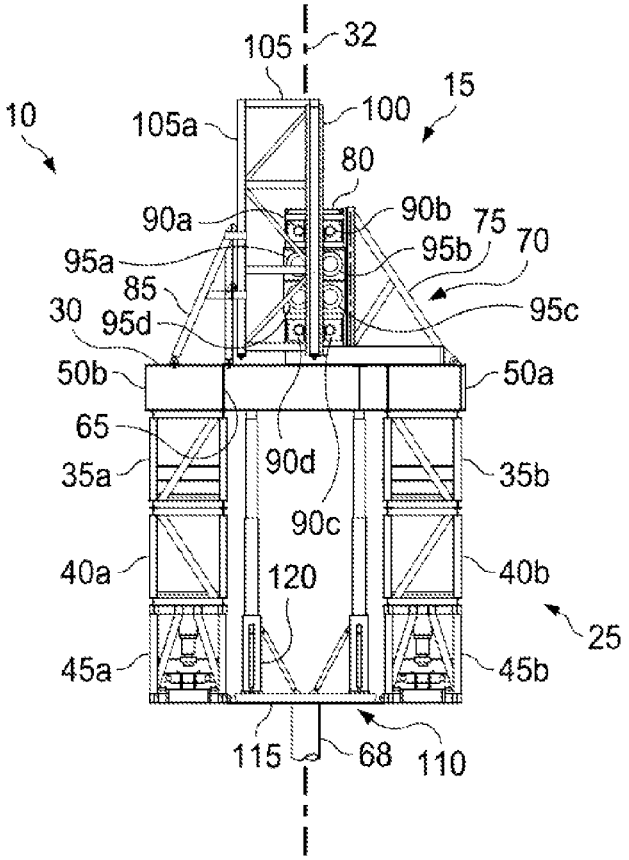
FIG. 1 is an elevational side view of an apparatus according to one or more aspects of the present disclosure.

It is to be understood that the following disclosure provides many different embodiments, or examples, for implementing different features of various embodiments. Specific examples of components and arrangements are described below to simplify the present disclosure. These are, of course, merely examples and are not intended to be limiting. In addition, the present disclosure may repeat reference numerals and/or letters in the various examples. This repetition is for the purpose of simplicity and clarity and does not in itself dictate a relationship between the various embodiments and/or configurations discussed. Moreover, the formation of a first feature over or on a second feature in the description that follows may include embodiments in which the first and second features are formed in direct contact, and may also include embodiments in which additional features may be formed interposing the first and second features, such that the first and second features may not be in direct contact.

Referring to FIG. 1, illustrated is an elevational view of an apparatus 10. The apparatus 10 may be used during the construction of a land-based drilling rig 15. In several exemplary embodiments, however, instead of a land-based drilling rig, the apparatus 10 may be used in connection with any type of drilling rig, such as a jack-up rig, a semi-submersible rig, a drill ship, a coil tubing rig, or a casing drilling rig, among others. In one embodiment, the drilling rig 15 includes a platform including at least a substructure 25 supporting a platform floor or a rig floor 30. In one embodiment, the platform includes the substructure and the platform or rig floor 30. In one embodiment, the drilling rig 15 extends longitudinally along an axis 32.

Figure 5A:
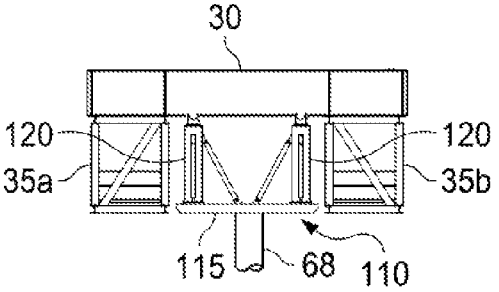
Figure 5B:
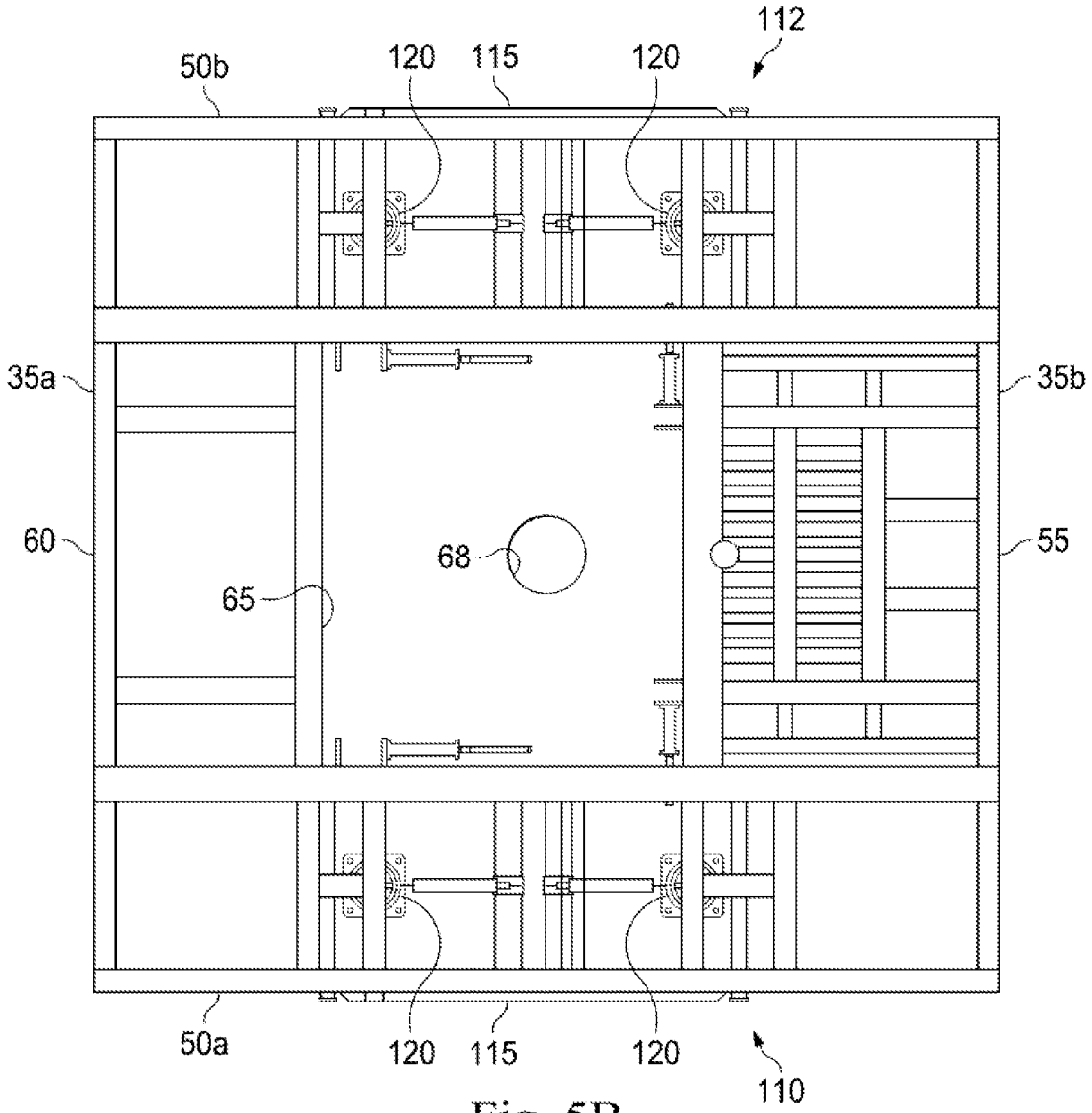
FIG. 5B is a plan view of the apparatus of FIG. 1, according to one or more aspects of the present disclosure.

Referring to FIGS. 1 and 5B, in one embodiment, the substructure 25 includes upper sub boxes 35*a* and 35*b*, middle sub boxes 40*a* and 40*b*, and lower sub boxes 45*a* and 45*b*. In one embodiment, the upper sub boxes 35*a* and 35*b* are attached to at least strong back frames 50*a* and 50*b*. In one embodiment, the strong back frames 50*a* and 50*b* are arranged in parallel or "at least substantially" (e.g., within 10 degrees) in parallel. In one embodiment, a setback spreader frame 55 and a rear spreader frame 60 are arranged in parallel or at least substantially in parallel and connect the strong back frames 50*a* and 50*b*. In one embodiment, the spreader frames 55 and 60 connect the strong back frames 50*a* and 50*b* to form an opening 65. In one embodiment, the spreader frames 55 and 60 and strong back frames 50*a* and 50*b* form the generally horizontal rig floor 30. In one embodiment, the rig floor 30 is adapted to be positioned above a wellbore 68, which can be a wellbore or a planned wellbore. In some embodiments, the opening 65 has an axis that is coaxial with an axis of the wellbore 68 and or the axis 32. In another embodiment, the opening 65 has an axis parallel or at least substantially parallel with the axis of the wellbore 68 and or the axis 32. In another embodiment, the opening 65 is generally above the wellbore 68. In another embodiment, the opening 65 is generally disposed above the wellbore 68 when the apparatus 10 is in operation.

In one embodiment, the apparatus 10 includes a drive carriage system 70 having a carriage frame 75 attached to the rig floor 30, a pinion drive carriage 80 attached to the carriage frame 75, and a stabilizer frame 85 attached to the rig floor 30. In one embodiment, the carriage frame 75 is attached to the rig floor 30 and extends vertically from the rig floor 30. In one embodiment, carriage frame 75 has an upper portion and an opposing lower portion connected to the rig floor 30. In one embodiment, the pinion drive carriage 80 is attached to the lower portion of the carriage frame 75 or the upper portion of the carriage frame 75. In one embodiment, the pinion drive carriage 80 can be attached to the carriage frame 75 using a pin system, bolts, screws, or any other type(s) of adequate fastener. In one embodiment, the pinion drive carriage 80 extends in a vertical direction parallel or at least substantially parallel with the longitudinal axis of the wellbore 68 and or the axis 32, and has a plurality of electric motors 90*a*, 90*b*, 90*c*, and 90*d*. Each pinion from a plurality of pinions 95*a*, 95*b*, 95*c*, and 95*d* is operably coupled to the respective electric motor 90*a*, 90*b*, 90*c*, and 90*d*. In one embodiment, each pinion from the plurality of pinions 95*a*, 95*b*, 95*c*, and 95*d* is adapted to engaged teeth of a rack 100 located on a longitudinal edge of a mast section 105*a*, 105*b*, 105*c*, 105*d* or 105*e* (the mast sections 105*b*, 105*c*, 105*d*, and 105*e* are not shown). In one embodiment, the electric motors 90*a*, 90*b*, 90*c*, and 90*d* cause the respective pinions operably coupled thereto to rotate and engage teeth of the rack 100. As a result, the mast sections 105*a*, 105*b*, 105*c*, 105*d*, and or 105*e* and the pinion drive carriage 80 move relative to each other. That is, if the pinion drive carriage 80 is attached to the rig floor 30, then activation of the electric motors 90*a*, 90*b*, 90*c*, and 90*d* causes the respective pinions operably coupled thereto to rotate and engage the teeth of the rack 100 so that the mast sections 105*a*, 105*b*, 105*c*, etc., move in a vertical direction relative to the pinion drive carriage 80. In one embodiment, if the mast section 105*a*, 105*b*, 105*c*, 105*d* or 105*e* is attached to the rig floor 30, then activation of the electric motors 90*a*, 90*b*, 90*c*, and 90*d* causes the respective pinions operably coupled thereto to rotate and engage the teeth of the rack 100 so that the pinion drive carriage 80 moves in a vertical direction relative to the mast section 105*a*, 105*b*, 105*c*, 105*d*, or 105*e*. In one embodiment, the mast sections 105*a*, 105*b*, 105*c*, 105*d*, and 105*e* extend along a first axis and move in a vertical direction along the first axis upon actuation of the plurality of motors 90*a*, 90*b*, 90*c*, and 90*d*. One embodiment of the pinions 95*a*, 95*b*, 95*c*, 95*d*, carriage 80, and motors 90*a*, 90*b*, 90*c*, and 90*d* are described in U.S. Application No. 61/646,686, which is hereby fully incorporated herein by express reference thereto. In one embodiment, multiple pinion drive carriages 80 can be used, including on an opposite side of the mast 105 by forming another vertical support as a second rack like rack 100. In another embodiment, an additional or alternative pinion drive carriage may be arranged in a vertical position relative to the depicted pinion drive carriage 80, such as below it under the rig floor 30. In one embodiment, the stabilizer frame 85 is attached to the rig floor 30 and extends vertically or at least substantially vertically therefrom. In one embodiment, the stabilizer frame 85 has a support extending vertically and parallel or at least substantially with the axis of the wellbore 68 and or the axis 32. In one embodiment, the stabilizer frame 85 engages and stabilizes the mast sections 105*a*, 105*b*, 105*c*, 105*d*, etc.

In one embodiment, the apparatus 10 also includes a frame moving system or a platform raising system 110 positioned or arranged relative to the wellbore 68. In one embodiment, the platform raising system 110 has a sub skid 115 and a plurality of actuators 120. In one embodiment, the sub skid 115 is movable and supports the plurality of actuators 120. In one embodiment, the sub skid 115 is rectangular, while in others it is square, trapezoidal, a parallelogram, or other quadrilateral shape. In another embodiment, the sub skid 115 may be any shape that is sufficiently sized to fit between the sub boxes while permitting the plurality of actuators 120 to be disposed over the sub skid 115. In one embodiment, the plurality of actuators 120 typically extends vertically, or in a vertical direction, from the sub skid 115. That is, each longitudinal axis of the plurality of actuators 120 is typically parallel or at least substantially parallel with the axis of the wellbore 68 and or the axis 32. In an exemplary embodiment, the plurality of actuators 120 are, or include, telescoping, hydraulic cylinders. In several exemplary embodiments, each of the actuators of the plurality of actuators 120 is, includes, or is part of, a hydraulic actuator, an electromagnetic actuator, a pneumatic actuator, a linear actuator, and/or any combination thereof. When actuated, each of the plurality of actuators 120 applies a force in a vertical direction, or in at least substantially vertical direction. In one embodiment, the plurality of actuators 120 extend or retract their respective lengths along a vertical or at least substantially vertical axis. In one embodiment, each actuator of the plurality of actuators 120 has one or more couplings 122 (shown in FIG. 3) that engage the rig floor 30. In one embodiment, a plurality of platform raising systems 110 are located below the rig floor 30.

In one embodiment, the drilling rig 15 includes a mast 105 including the mast sections 105*a*, 105*b*, 105*c*, 105*d*, and 105*e*. In one embodiment, the mast sections 105*a*, 105*b*, 105*c*, 105*d*, and 105*e* are temporarily attached together to form the mast 105. In one embodiment, the mast sections 105*a*, 105*b*, 105*c*, 105*d*, and 105*e* are temporarily attached together to form the mast 105 using a bolt and pin system, wherein an opening on a lower section of the mast section 105*a* and an opening on an upper section of the mast section 105*b* are attached using a bolt or pin or both (not shown). This permits the methods described herein to be reversed to disassemble the apparatus to facilitate movement thereof to a new wellbore or other location. In one embodiment, however, the mast sections are permanently joined as they are connected. In some embodiments, the mast 105 extends through the opening 65. In one embodiment, the mast 105 is coupled to the rig floor 30.

Figure 2A:
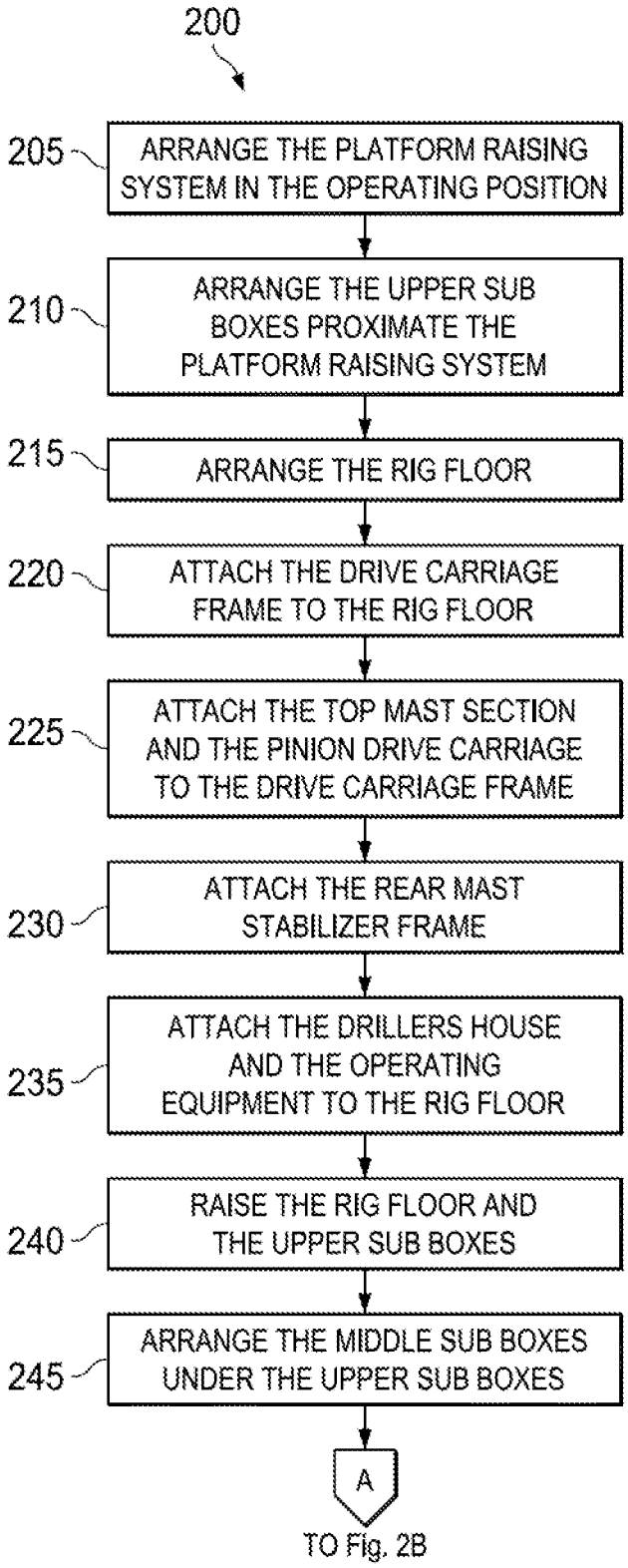
FIGS. 2A-2C are flow chart illustrations that together describe a method of operating the apparatus of FIG. 1, according to an exemplary embodiment.
Figure 2B:
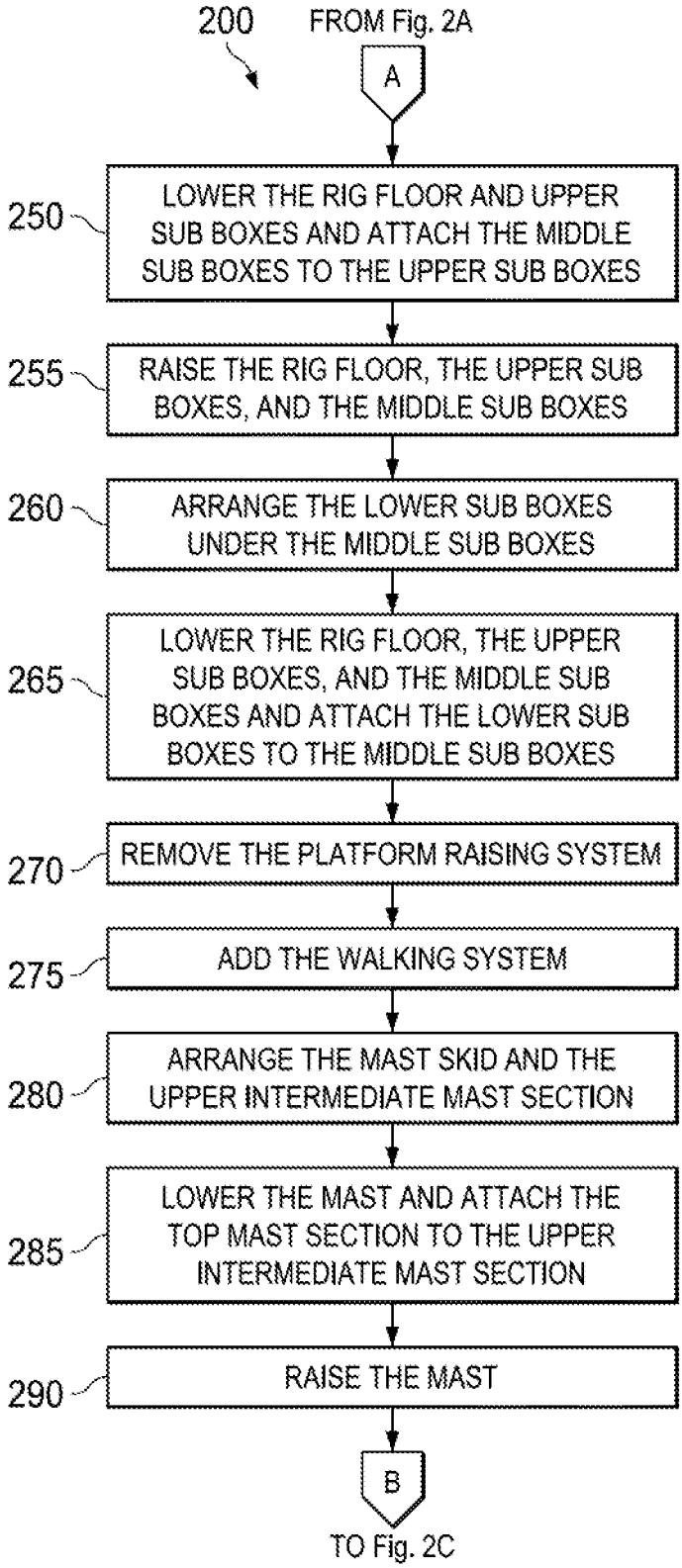
Figure 2C:
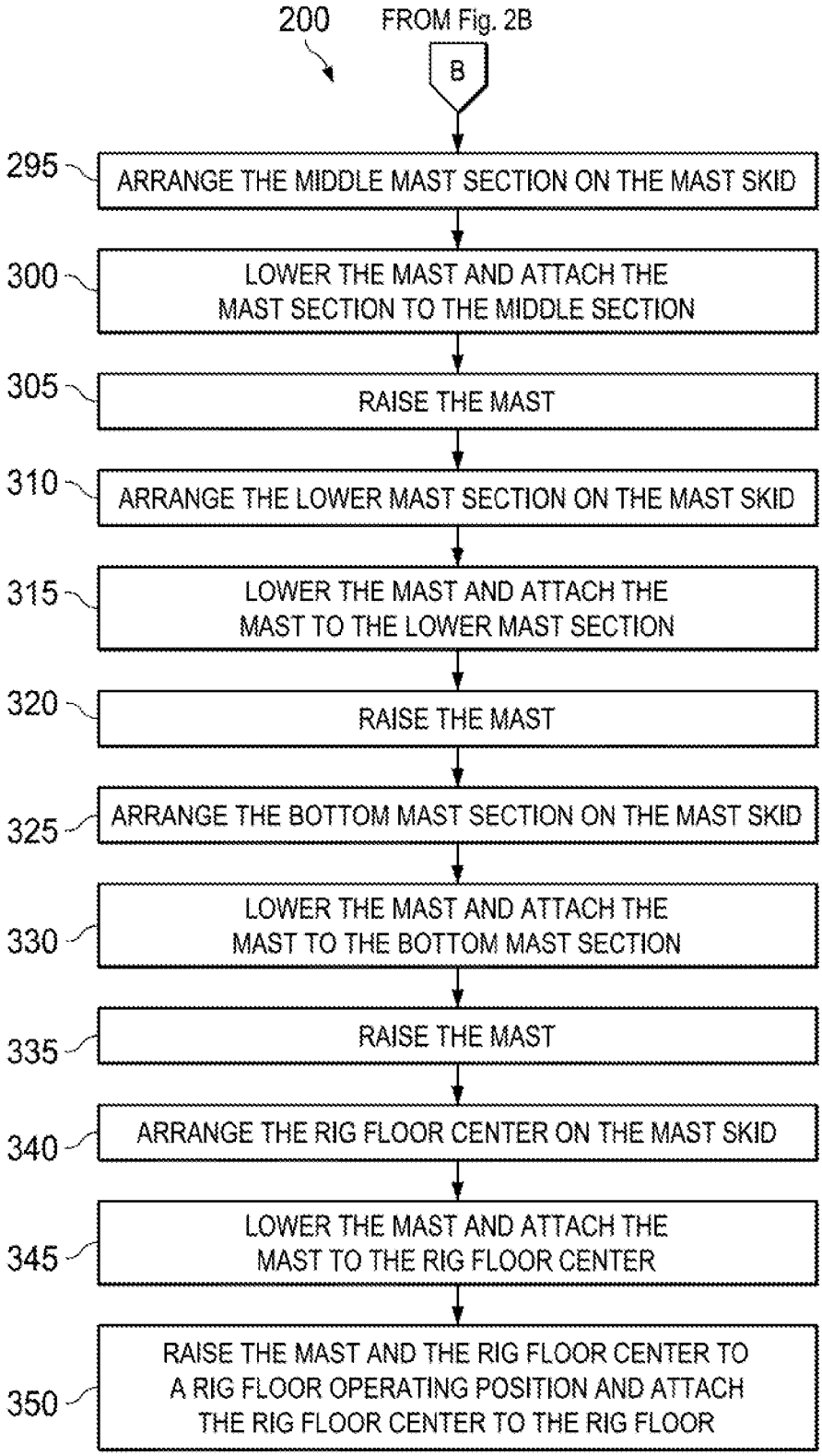

In an exemplary embodiment, as illustrated in FIGS. 2A-2C, with continuing reference to FIG. 1, a method of operating the apparatus 10 is generally referred to by the reference numeral 200. In an exemplary embodiment, the execution of the method 200 results in the construction of the substructure 25, the rig floor 30, and the mast 105.

Figure 3:
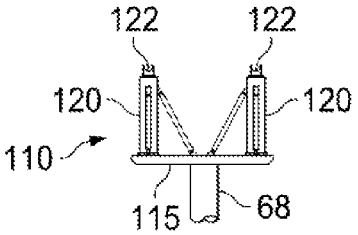

At step 205 and as shown in FIGS. 3 and 5B, the platform raising system 110 of the apparatus 10 is located near or proximate the wellbore 68 in an operating position. In an exemplary embodiment, a first platform raising system 110 and a second platform raising system 112 are located on opposing sides of the wellbore 68 in the operating position. In an exemplary embodiment, a first platform raising system 110 and the second platform raising system 112 are located in parallel on opposing sides of the wellbore 68 in the operating position. In an exemplary embodiment, a first platform raising system 110 and the second platform raising system 112 are located proximate a wellbore site, which is a site including the wellbore 68.

Figure 4:
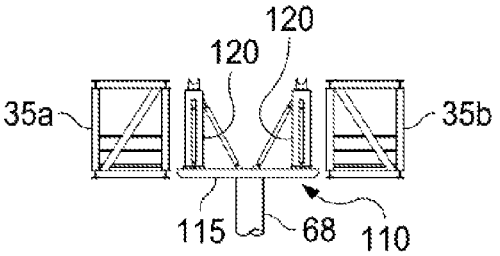

At step 210 and as shown in FIG. 4, the upper sub boxes 35*a* and 35*b* are arranged adjacent to or proximate the platform raising system 110. In one embodiment, the upper sub boxes 35*a* and 35*b* are arranged in parallel or at least substantially in parallel. In one embodiment, the upper sub boxes 35*a* and 35*b* are arranged so that the platform raising system 110 is located between the upper sub box 35*a* and the upper sub box 35*b*.

At step 215 and as shown in FIGS. 5A and 5B, the rig floor 30 is arranged. The strong back frames 50*a* and 50*b*, the setback spreader frame 55, and or the rear spreader frame 60 are attached to the upper sub boxes 35*a* and 35*b*. The strong back frame 50*a* and the strong back frame 50*b* are located above the platform raising system 110. The couplings 122 are adapted to engage the strong back frames 50*a* and 50*b*.

Figure 6:
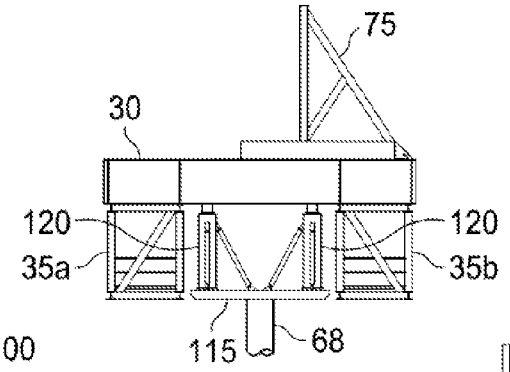
FIGS. 6-30 are views similar to that of FIG. 1, but depict the apparatus of FIG. 1 in different operational modes, according to one or more aspects of the present disclosure.

At step 220 and as shown in FIG. 6, the drive carriage frame 75 is attached to the rig floor 30. The drive carriage frame 75 may be attached to the rig floor 30 using a pin system, bolts, screws, or any other type(s) of adequate fastener(s). As to all fasteners discussed herein, these may be independently selected to be permanent or releasable fasteners, which will depend on whether it is desired that the apparatus, or portion thereof, is to remain assembled or to be disassembled, moved, and either stored or reassembled at another wellbore site.

Figure 7:
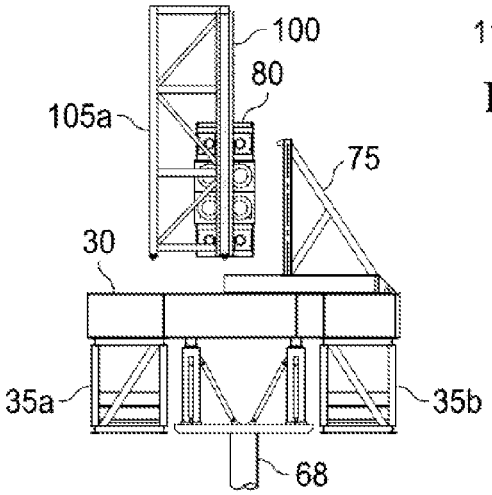
Figure 8:
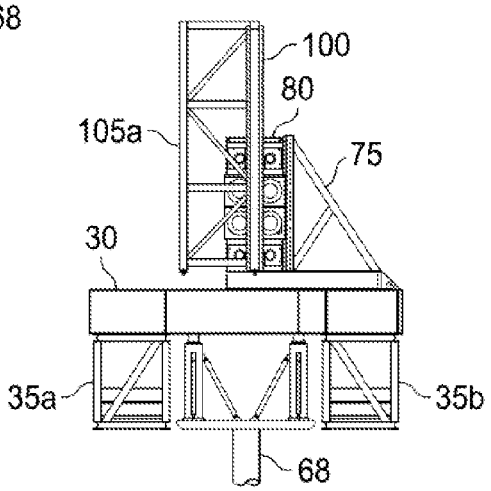

At step 225 and as shown in FIGS. 7 and 8, the mast section 105*a* and the pinion drive carriage 80 are attached to the pinion drive carriage frame 75. In one embodiment, the teeth of the rack 100 of the mast section 105*a* engage the pinions 95*a*, 95*b*, 95*c*, and 95*d* (not shown in FIGS. 7 and 8) on the pinion drive carriage 80 so the mast section 105*a* and the pinion drive carriage 80 are coupled. In one embodiment, the pinion drive carriage 80 is attached to the drive carriage frame 75 using a pin system, bolts, screws, or any other type(s) of adequate fastener.

Figure 9:
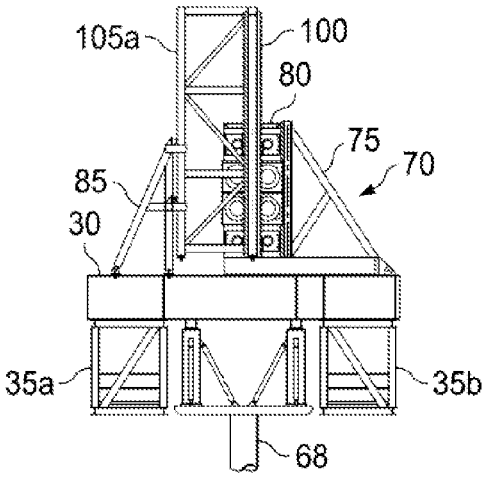

At step 230 and as shown in FIG. 9, the rear mast stabilizer frame 85 is attached to the rig floor 30. The rear mast stabilizer frame 85 may be coupled to the rig floor 30 using a pin system, bolts, screws, or any other type(s) of adequate fastener(s).

Figure 10:
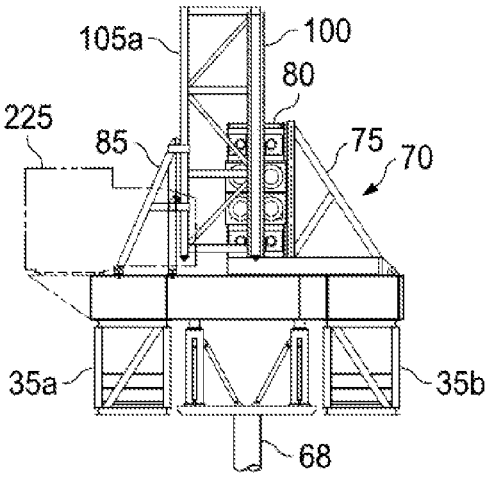

At step 235 and as shown in FIG. 10, a driller house and operating equipment 225 is attached to the rig floor 30. The driller house and operating equipment 225 may be coupled to the rig floor 30 using a pin system, bolts, screws, or any other type(s) of adequate fastener(s).

At step 240, the plurality of actuators 120 are extended so that the couplings 122 engage the rig floor 30. In one embodiment, the plurality of actuators 120 are extended so that a vertical force is applied to the rig floor 30, lifting or raising the rig floor 30 and the upper sub boxes 35*a* and 35*b* to a first position. In one embodiment, the first position is a position at which the middle sub boxes 40*a* and 40*b* may be arranged below the upper sub boxes 35*a* and 35*b*, respectively. In one embodiment, the plurality of actuators 120 are extendable to at least a first height corresponding to the first position.

At step 245, the middle sub boxes 40*a* and 40*b* are arranged below the upper sub boxes 35*a* and 35*b*, respectively. That is, the middle sub box 40*a* is arranged below the upper sub box 35*a* and the middle sub box 40*b* is arranged below the upper sub box 35*b*. In one embodiment, the middle sub boxes 40*a* and 40*b* are arranged below the upper sub boxes 35*a* and 35*b* so that the middle sub boxes 40*a* and 40*b* may be attached to the upper sub boxes 35*a* and 35*b*, respectively, upon the lowering of the upper sub boxes 35*a* and 35*b*.

Figure 11:
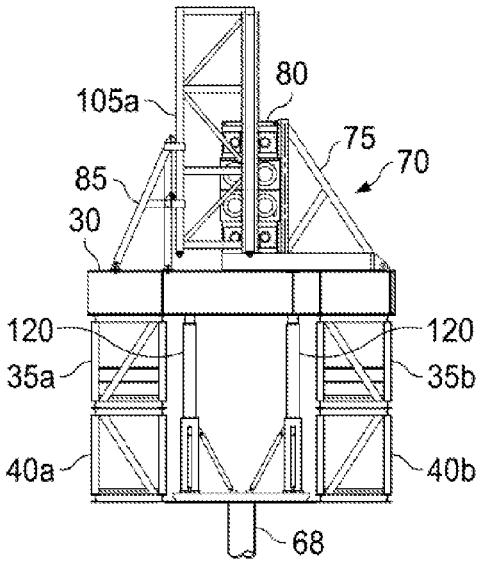

At step 250, and as shown in FIG. 11, the plurality of actuators 120 are retracted so that the rig floor 30 and the attached upper sub boxes 35*a* and 35*b* are lowered to a second position at which the middle sub boxes 40*a* and 40*b* may be attached to the upper sub box 35*a* and 35*b*, respectively. In one embodiment, the plurality of actuators 120 are retractable to at least a second height that corresponds to the second position. In one embodiment, the middle sub box 40*a* is attached to the upper sub box 35*a* and the middle sub box 40*b* is attached to the upper sub box 35*b*. The upper sub boxes 35*a* and 35*b* may be coupled to the middle sub boxes 40*a* and 40*b* using a pin system, bolts, screws, or any other type(s) of adequate fastener(s).

At step 255, and as shown in FIG. 1, the plurality of actuators 120 are extended so that the vertical force is applied to the rig floor 30, lifting the rig floor 30, the upper sub boxes 35*a* and 35*b*, and the middle sub boxes 40*a* and 40*b* to a third position. In one embodiment, the third position is a position at which the lower sub boxes 45*a* and 45*b* may be arranged below the middle sub boxes 40*a* and 40*b*, respectively. In one embodiment, the plurality of actuators 120 are extendable to at least a third height corresponding to the third position at which the lower sub box 45*a* may be arranged below the middle sub box 40*a* and the lower sub box 45*b* may be arranged below the middle sub box 40*b*.

At step 260, the lower sub boxes 45*a* and 45*b* are arranged below the middle sub boxes 40*a* and 40*b*, in a similar manner to that which the middle sub boxes 40*a* and 40*b* are arranged below the upper sub boxes 35*a* and 35*b* at step 245.

At step 265, and as shown in FIG. 1, the plurality of actuators 120 are retracted so that the rig floor 30, the upper sub boxes 35*a* and 35*b*, and the middle sub boxes 40*a* and 40*b* are lowered to a fourth position at which the lower sub boxes 45*a* and 45*b* may be attached to the middle sub box 40*a* and 40*b*, respectively. In one embodiment, the plurality of actuators 120 are retractable to at least a fourth height that corresponds to the fourth position at which lower sub boxes 45*a* and 45*b* may be attached to the middle sub boxes 40*a* and 40*b*, respectively. The middle sub box 40*a* is attached to the lower sub box 45*a* and the middle sub box 40*b* is attached to the lower sub box 45*a* in a similar manner to that which the upper sub boxes 35*a* and 35*b* are attached to the middle sub boxes 40*a* and 40*b* at step 250.

At step 270, the plurality of actuators 120 are retracted to disengage from the rig floor 30 and the platform raising system 110 is be removed from below the rig floor 30.

Figure 12:
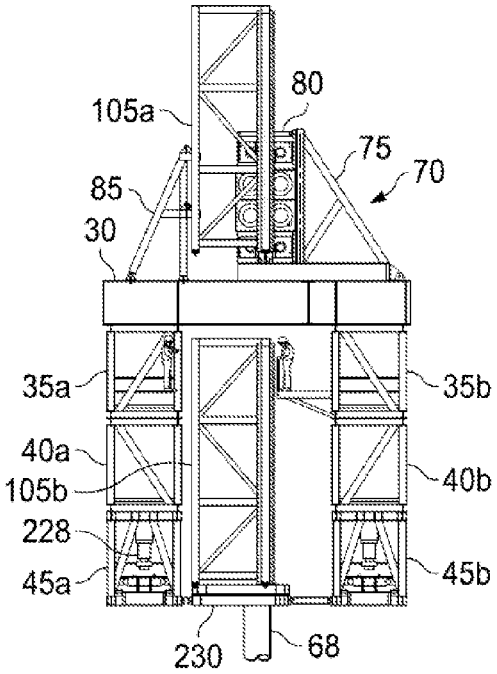

At step 275 and as shown in FIG. 12, a walking system 228 is attached or operably coupled to the substructure 25. The walking system 228 may include one or more catwalks or other walkable structures that are attached to the apparatus 10 and sufficient to support one or more persons.

In an alternative embodiment, step 275 is omitted and the walking system 228 is included in the lower sub boxes 45*a* and 45*b*, the middle sub boxes 40*a* and 40*b*, or the upper sub boxes 35*a* and 35*b*.

At step 280 and as shown in FIG. 12, a mast skid 230 is arranged below the rig floor 30. In one embodiment, the mast skid 230 is rectangular, while in others it is square, trapezoidal, a parallelogram, or other quadrilateral shape. In another embodiment, the mast skid 230 may be any shape that is sufficiently sized to fit between the sub boxes while permitting the plurality of actuators 120 to be disposed over the mast skid 230. In one embodiment, the mast skid 230 accommodates a mast section, such as the mast section 105*a*, 105*b*, 105*c*, etc., so that the mast sections 105*b*, 105*c*, etc., may be placed on the mast skid 230 in a vertical position. That is, a longitudinal axis of the mast section 105*a*, 105*b*, 105*c*, etc., is parallel or at least substantially parallel with the axis of the wellbore 68 and or the axis 32. The mast skid 230 is located such that the mast sections 105*a*, 105*b*, etc., are located beneath the opening 65 of the rig floor 30. In one embodiment, the mast section 105*b* is arranged on the mast skid 230 below the rig floor 30 in a vertically or typically vertical position below the mast section 105*a*. In one embodiment, the mast section 105*b* is arranged on the mast skid 230 in a vertical position. That is, a longitudinal axis of the mast section 105*b* is parallel with, at least substantially parallel with, or coaxial to a longitudinal axis of the wellbore 68 and or the axis 32. In one embodiment, the longitudinal axis of the mast section 105*b* is parallel with, at least substantially parallel with, or coaxial to a longitudinal axis of the opening 65. In one embodiment, the mast section 105*b* is located below the opening 65 so that the mast section 105*b* may pass through the opening 65.

Figure 13:
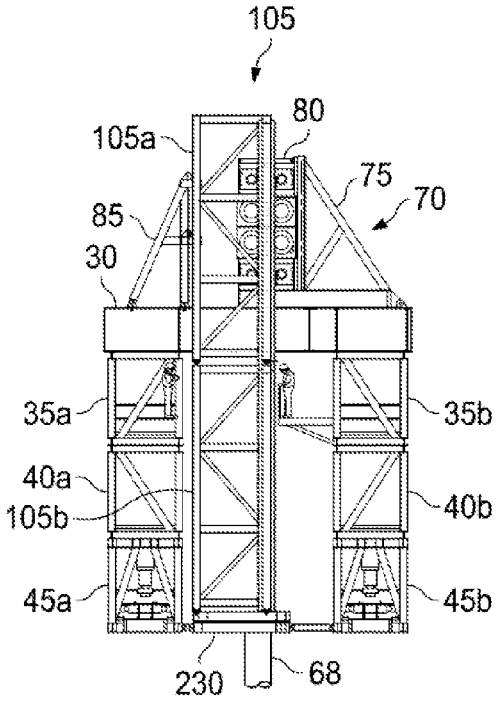

At step 285 and as shown in FIG. 13, the mast 105, which includes the mast section 105*a*, is lowered, using the pinion drive carriage 80, to a position at which the mast section 105*a* may connect with the mast section 105*b*. In one embodiment, an upper portion of the mast section 105*b* is connected to a lower portion of the mast section 105*a* using a pin and bolt system. In another embodiment, the mast section 105*b* is connected to the mast section 105*a* using bolts, screws, or any other type(s) of adequate fastener(s).

Figure 14:
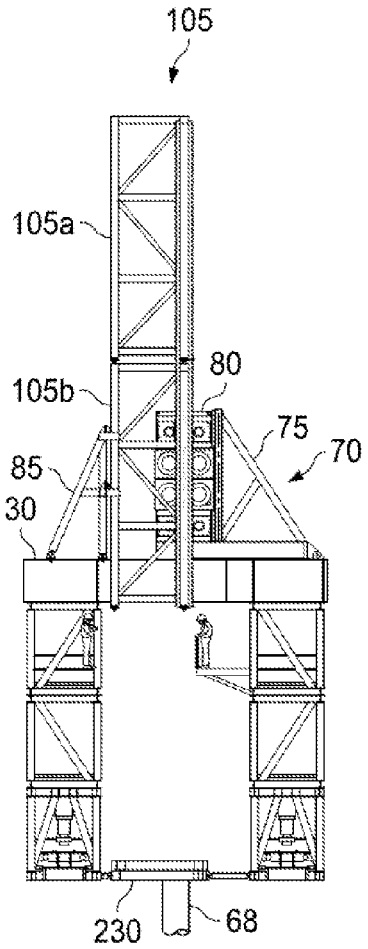

At step 290 and as shown in FIG. 14, the mast 105, which includes the mast sections 105*a* and 105*b*, is raised in an upward or vertical direction away from the mast skid 230 using the pinion drive carriage 80.

Figure 15:
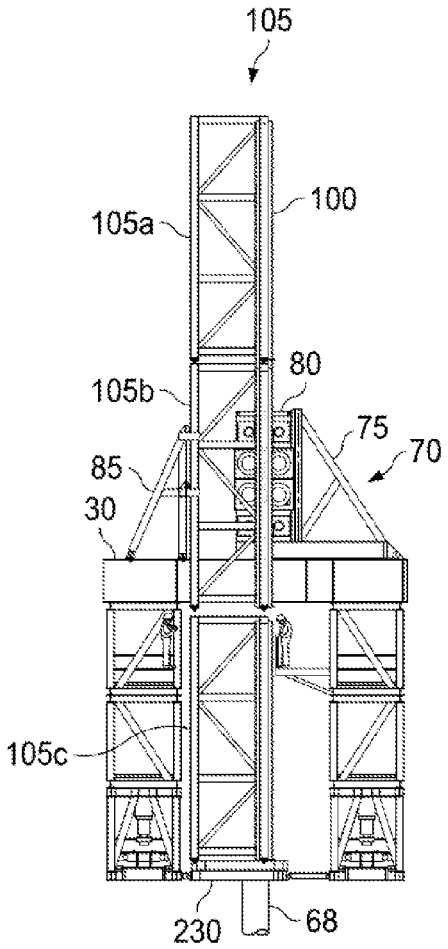

At step 295 and as shown in FIG. 15, the mast section 105*c* is arranged on the mast skid 230 below the rig floor 30. In one embodiment, the mast section 105*c* is arranged on the mast section in a vertically or typically vertical position below the mast section 105*b*. In one embodiment, the mast section 105*c* is arranged on the mast skid 230 in a manner similar to that which the mast section 105*b* is arranged on the mast skid 230 at step 280.

Figure 16:
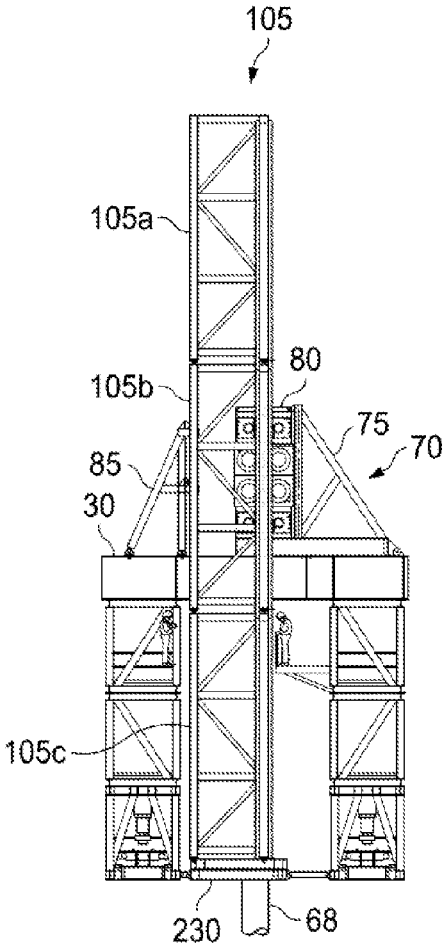

At step 300 and as shown in FIG. 16, the mast 105, which includes the mast sections 105*a* and 105*b*, is lowered and attached to the mast section 105*c* in a manner similar to that which the mast 105 is lowered and attached to the mast section 105*b* at step 285.

Figure 17:
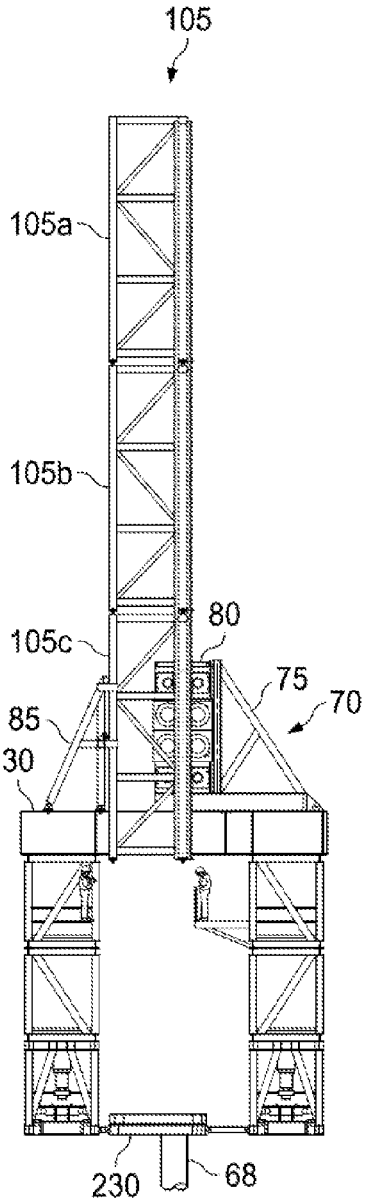

At step 305 and as shown in FIG. 17, the mast 105, which includes the mast sections 105*a*, 105*b*, and 105*c*, is raised in an upward or vertical direction away from the mast skid 230 using the pinion drive carriage 80.

Figure 18:
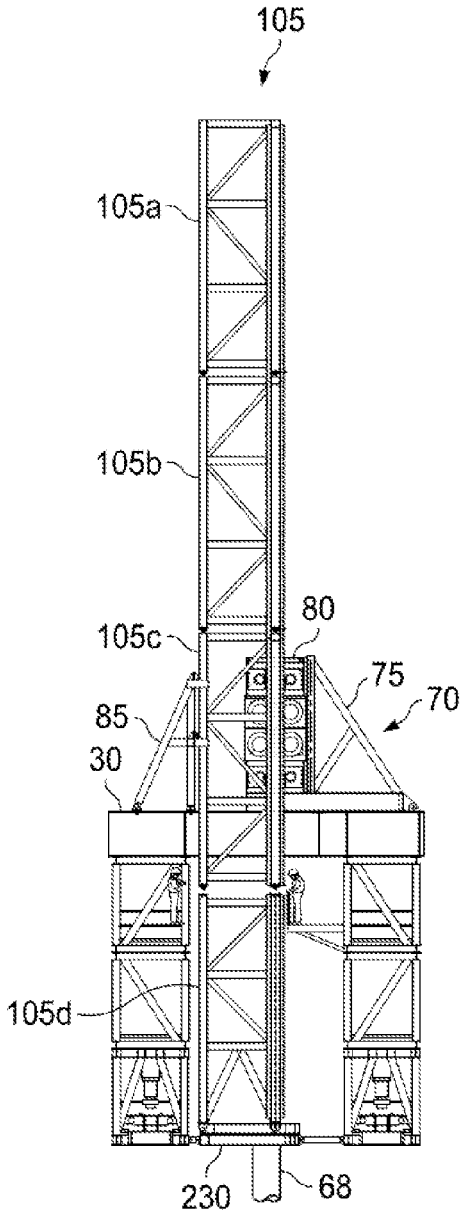

At step 310 and as shown in FIG. 18, the mast section 105*d* is arranged on the mast skid 230 below the rig floor 30 in a vertically or typically vertical position below the mast section 105*c*. In one embodiment, the mast section 105*d* is arranged on the mast skid 230 in a manner similar to that which the mast section 105*b* is arranged on the mast skid 230 at step 280.

Figure 19:
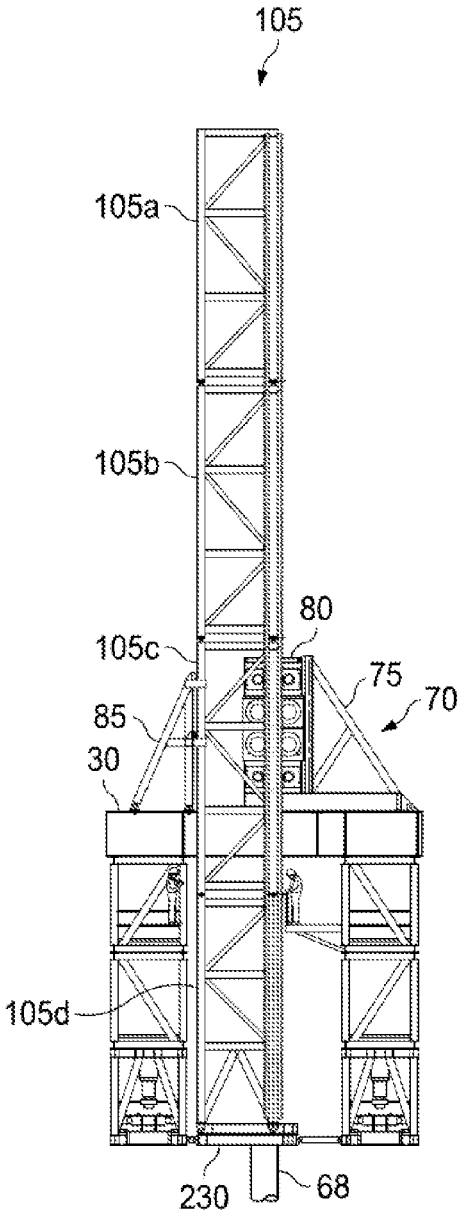

At step 315 and as shown in FIG. 19, the mast 105, which includes the mast sections 105*a*, 105*b* and 105*c*, is lowered and attached to the mast section 105*d* in a manner similar to that which the mast section 105*a* is attached to the mast section 105*b* at step 285.

Figure 20:
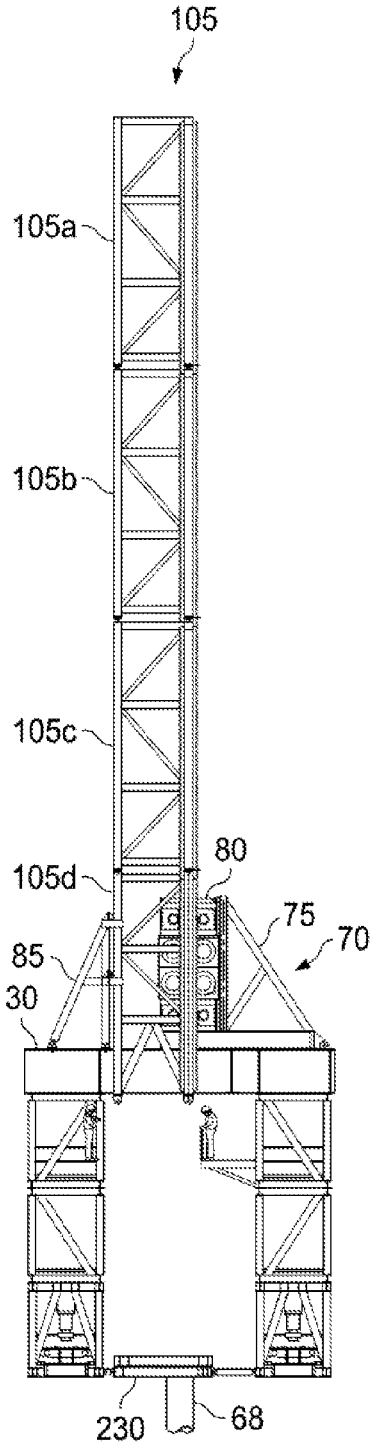

At step 320 and as shown in FIG. 20, the mast 105, which includes the mast sections 105*a*, 105*b*, 105*c*, and 105*d*, is raised in an upward or vertical direction away from the mast skid 230 using the pinion drive carriage 80.

At step 325, the mast section 105*e* is arranged on the mast skid 230 below the rig floor 30 in a vertically or typically vertical position below the mast section 105*d*. In one embodiment, the mast section 105*e* is arranged on the mast skid 230 in a manner similar to that which the mast section 105*b* is arranged on the mast skid 230 at step 280.

Figure 21:
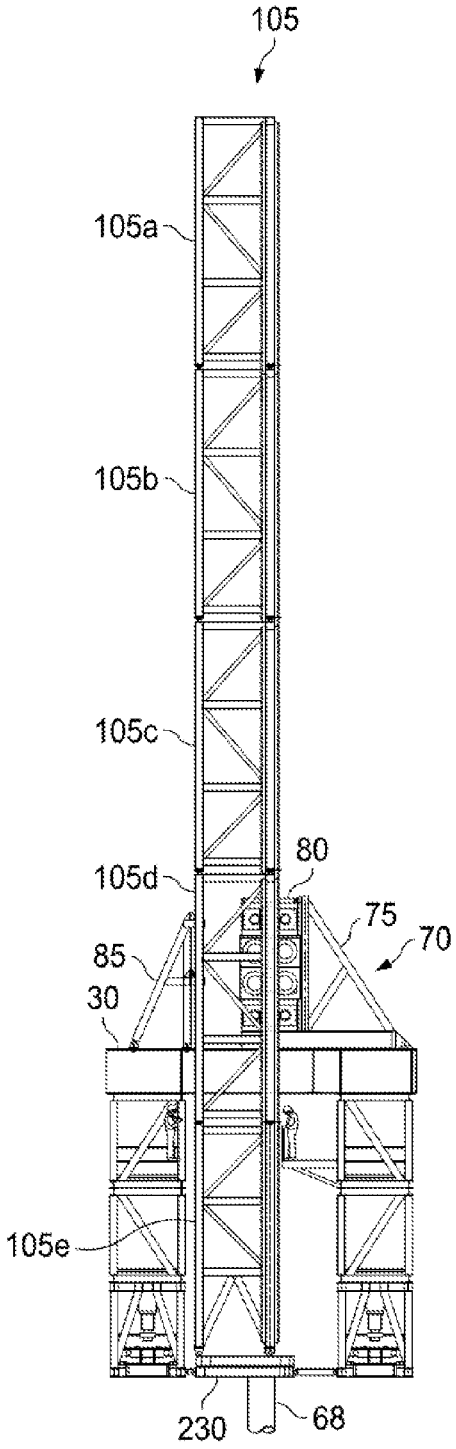

At step 330 and as shown in FIG. 21, the mast 105, which includes the mast sections 105*a*, 105*b*, 105*c*, and 105*d*, is lowered and attached to the mast section 105*e* in a manner similar to that which the mast section 105*a* is attached to the mast section 105*b* at step 285.

Figure 22:
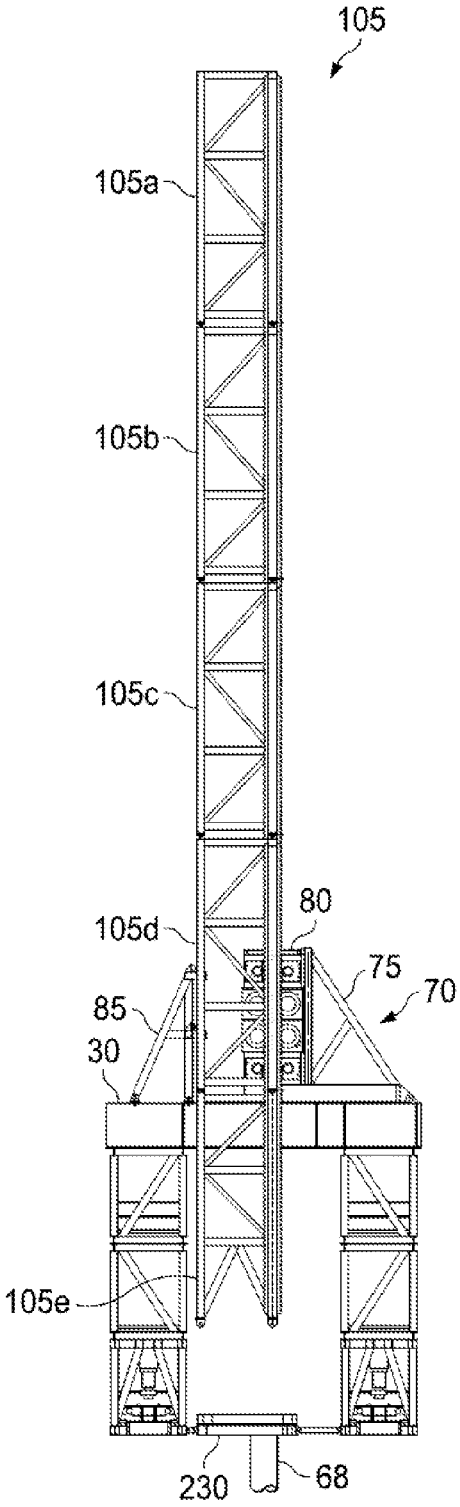

At step 335 and as shown in FIG. 22, the mast 105, which includes the mast sections 105*a*, 105*b*, 105*c*, 105*d*, and 105*e*, is raised in an upward or vertical direction away from the mast skid 230 using the pinion drive carriage 80.

Figure 23:
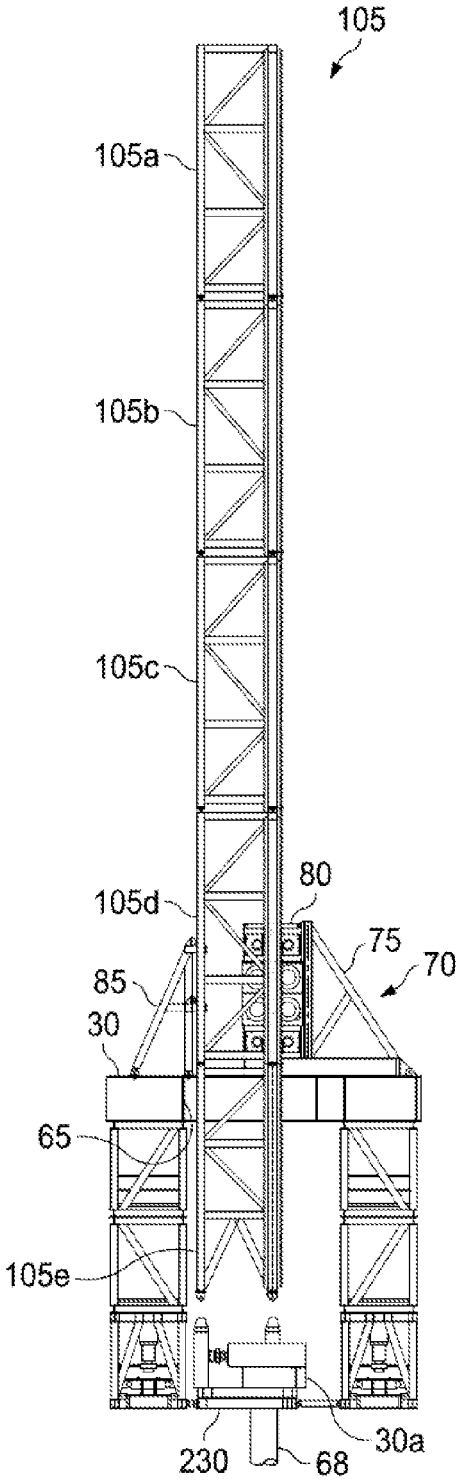

At step 340 and as shown in FIG. 23, a rig floor center 30*a* is arranged on the mast skid 230 below the rig floor 30. In one embodiment, the rig floor center 30*a* is a portion of the rig floor 30 and is sized to allow for the rig floor center 30*a* to be accommodated within the opening 65. In one embodiment, the rig floor center 30*a* is a rotary section that connects to the rig floor 30 during drilling. In one embodiment, the rig floor center 30*a* may include a rotating system or rotating equipment, such as a rotary-table system, turntable, or master bushing and Kelly drive bushing. In another embodiment, the rig floor center 30*a* includes a rotary table skid.

Figure 24:
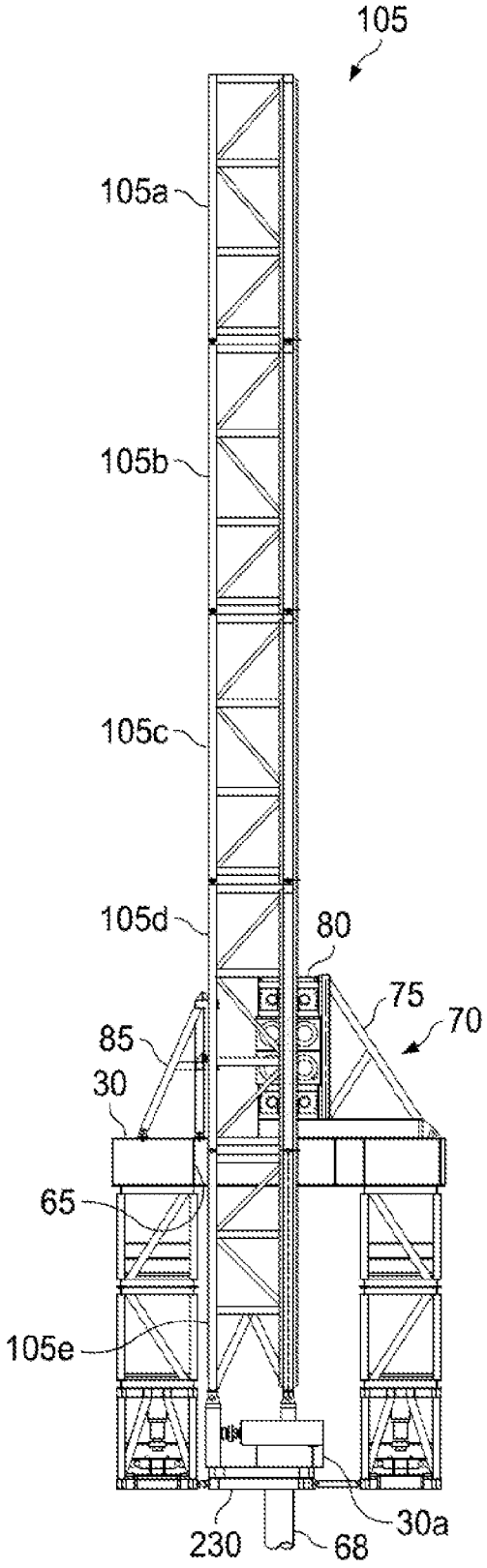

At step 345 and as shown in FIG. 24, the mast 105, which includes the mast sections 105*a*, 105*b*, 105*c*, 105*d*, and 105*e*, is lowered and attached to the rig floor center 30*a* in a manner similar to that which the mast section 105*a* is attached to the mast section 105*b* at step 285.

Figure 25:
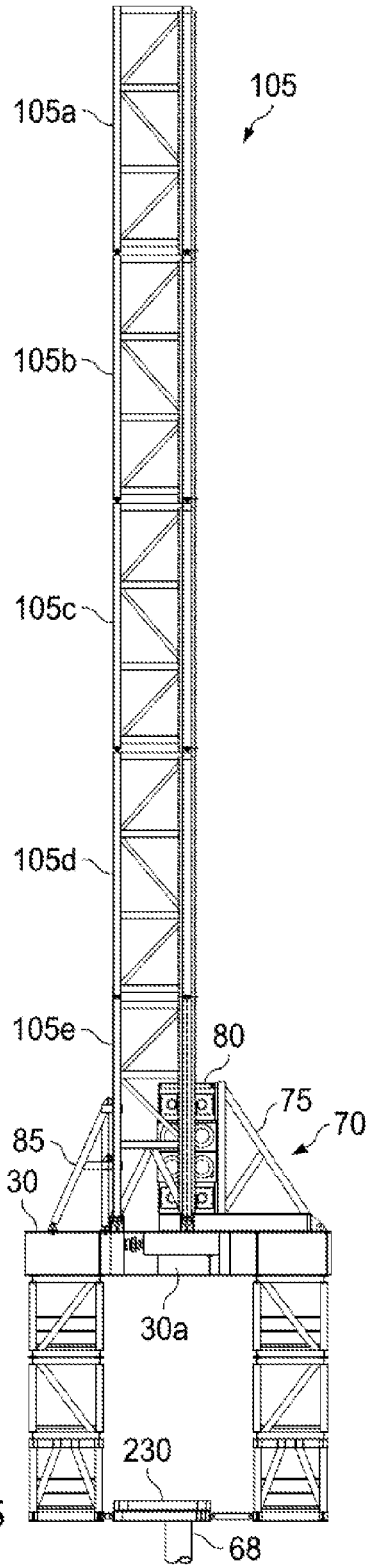

At step 350 and as shown in FIG. 25, the mast 105 and the rig floor center 30*a* are raised in the upward or vertical direction away from the mast skid 230 using the pinion drive carriage 80 to a rig floor operating position and attached to the rig floor 30. In one embodiment, the rig floor operation position is a position at which the rig floor center 30*a* is located during operation of the drilling rig 15. In one embodiment, the rig floor center 30*a* is attached to the rig floor 30 using a pin and bolt system (not shown). In another embodiment, the rig floor center 30*a* is connected to the rig floor 30 using bolts, screws, or any other type(s) of adequate fastener(s). In one embodiment, hydraulic actuators are used to secure pins located on the rig floor center 30*a* into plates located on the rig floor 30 that receive the pins. In another embodiment, hydraulic actuators are used to secure pins located on the rig floor 30 into plates located on the rig floor center 30*a* that receive the pins.

Figure 26:
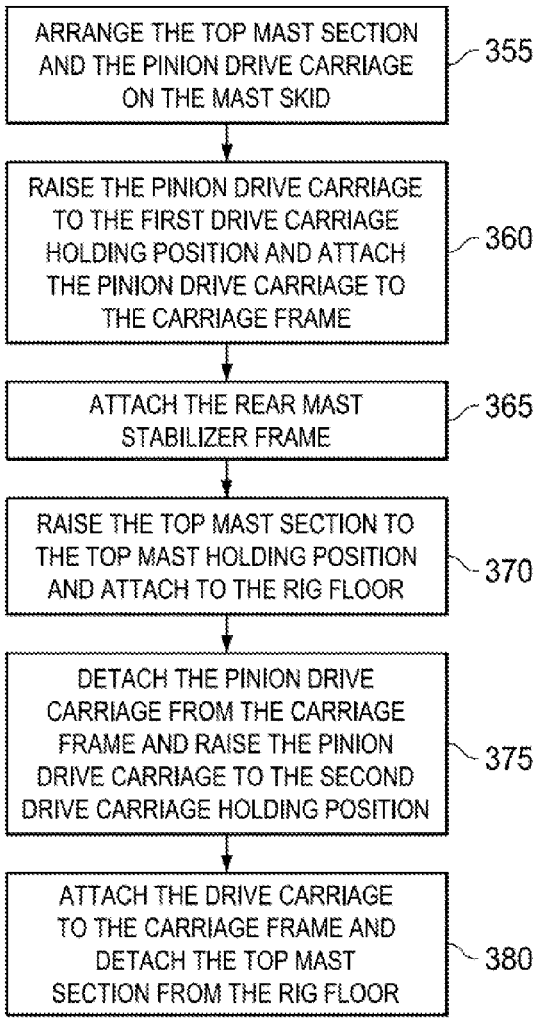

In an alternative embodiment, as illustrated in FIG. 26, with continuing reference to FIG. 1-2C, steps 225 and 230 of the method 200 may be replaced by steps 355, 360, 365, 370, 375 and 380 as described below.

Figure 27:
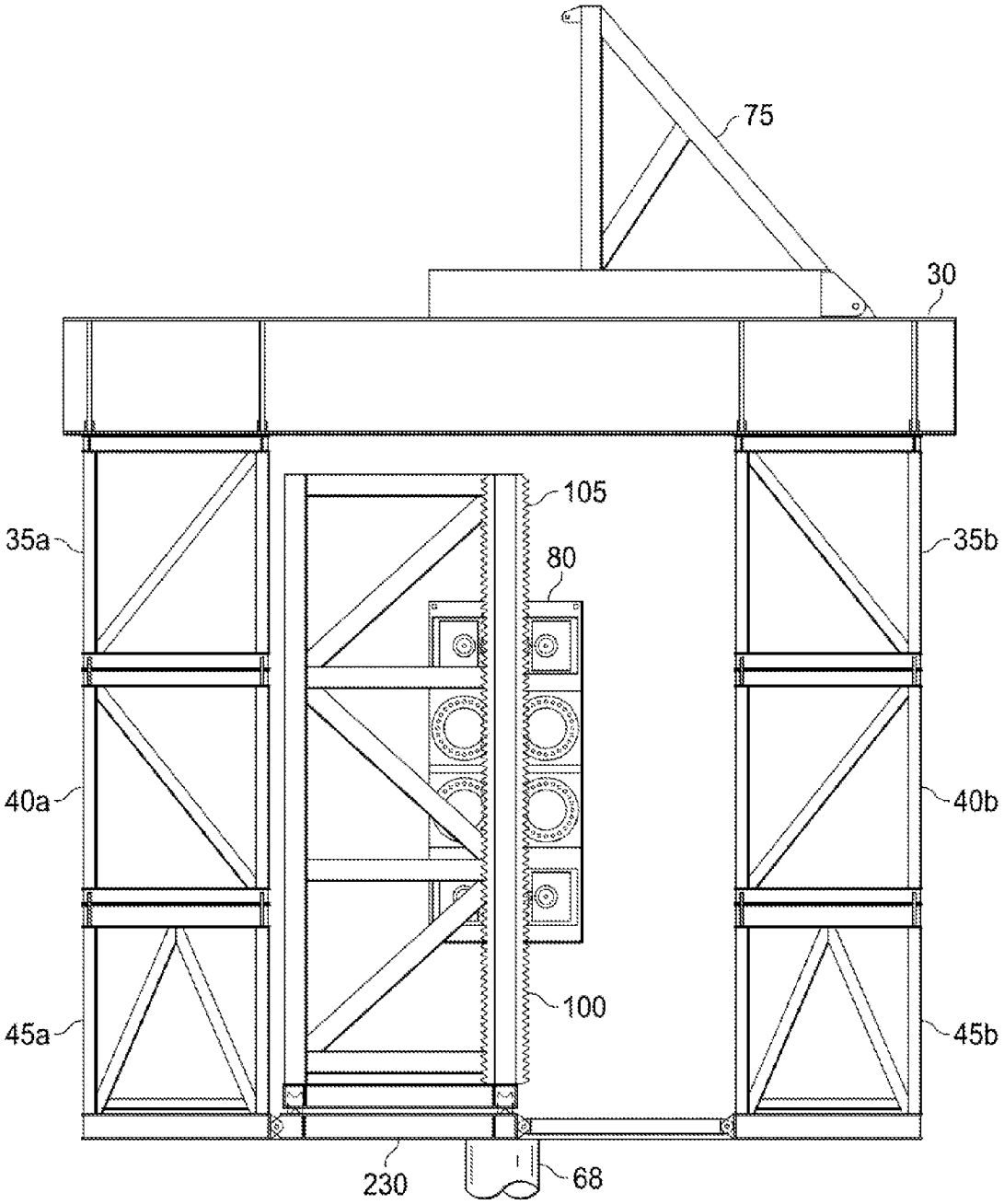

At step 355 and as shown in FIG. 27, the mast section 105*a* and the pinion drive carriage 80 are arranged on the mast skid 230 below the rig floor 30 in a vertically or typically vertical position. That is, a longitudinal axis of the mast section 105*a* is parallel with, at least substantially parallel with, or coaxial to a longitudinal axis of the wellbore 68 and or the axis 32. In one embodiment, the longitudinal axis of the mast section 105*a* is parallel with, at least substantially parallel with, or coaxial to a longitudinal axis of the opening 65. In one embodiment, the mast section 105*a* is located below the opening 65 so that the mast section 105*a* may pass through the opening 65. The pinion drive carriage 80 is operably coupled to the mast section 105*a*.

Figure 28:
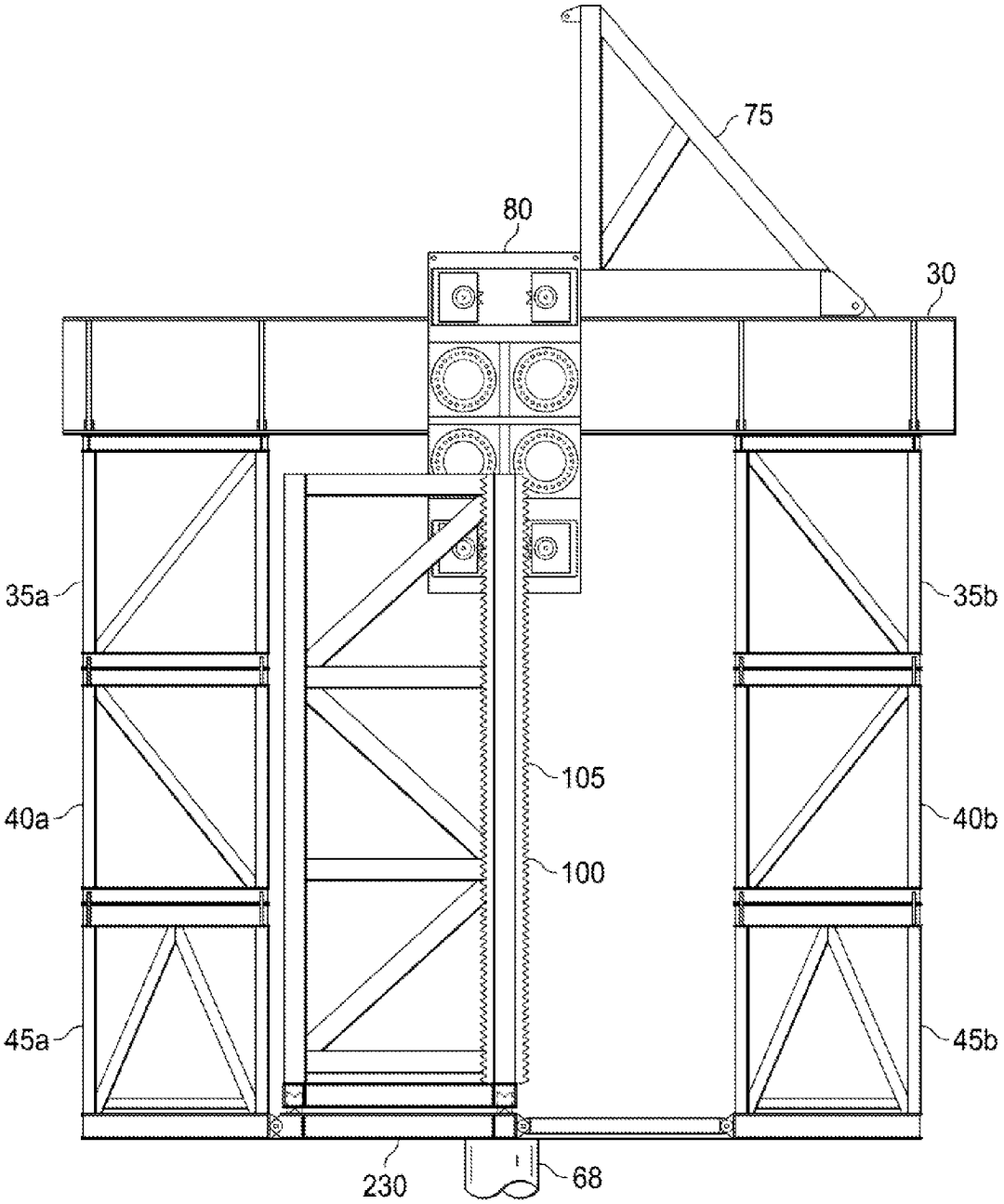

At step 360 and as shown in FIG. 28, the pinion drive carriage 80 travels vertically along the rack 100 of the mast section 105*a* so that at least a portion of the pinion drive carriage 80 passes through the opening 65 to a first drive carriage holding position and attaches to the carriage frame 75. In one embodiment, the pinion drive carriage 80 travels vertically to the first drive carriage holding position at which the pinion drive carriage 80 may be attached to the carriage frame 75. In one embodiment, the first pinion drive holding position is associated with a height at which an upper portion of the pinion drive carriage 80 attaches to the lower portion of the carriage frame 75.

Figure 29:
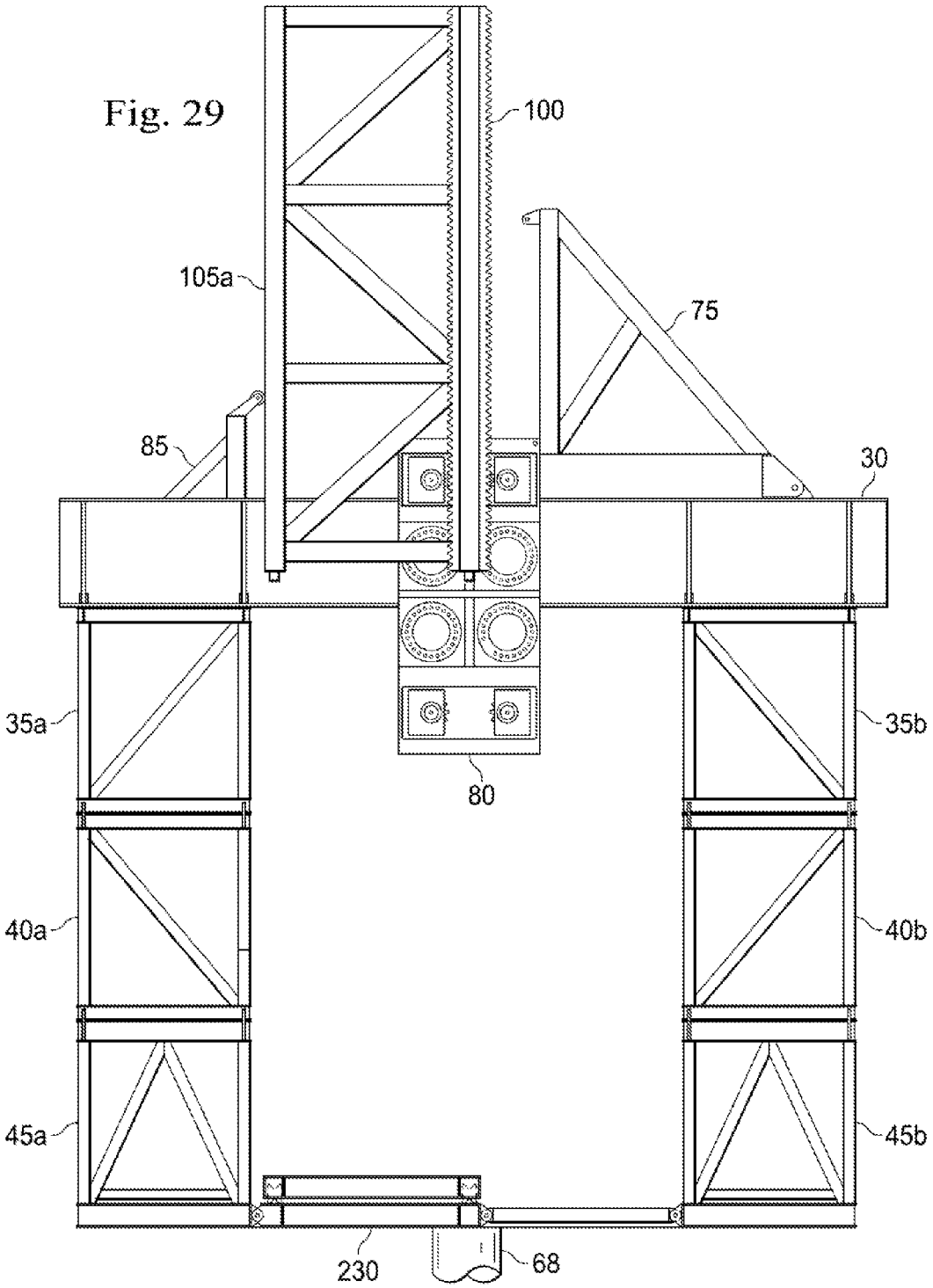

At step 365 and as shown in FIG. 29, the rear mast stabilizer frame 85 is attached to the rig floor 30. In one embodiment, the rear mast stabilizer frame 85 may be coupled to the rig floor 30 using a pin system, bolts, screws, or any other type(s) of adequate fastener(s).

At step 370, the mast section 105*a* is raised, using the pinion drive carriage 80, through the opening 65 and is attached to the rig floor 30. In one embodiment, the mast section 105*a* is attached to the rig floor 30 using holding locks, a pin system, bolts, screws, or any other type(s) of adequate fastener(s).

Figure 30:
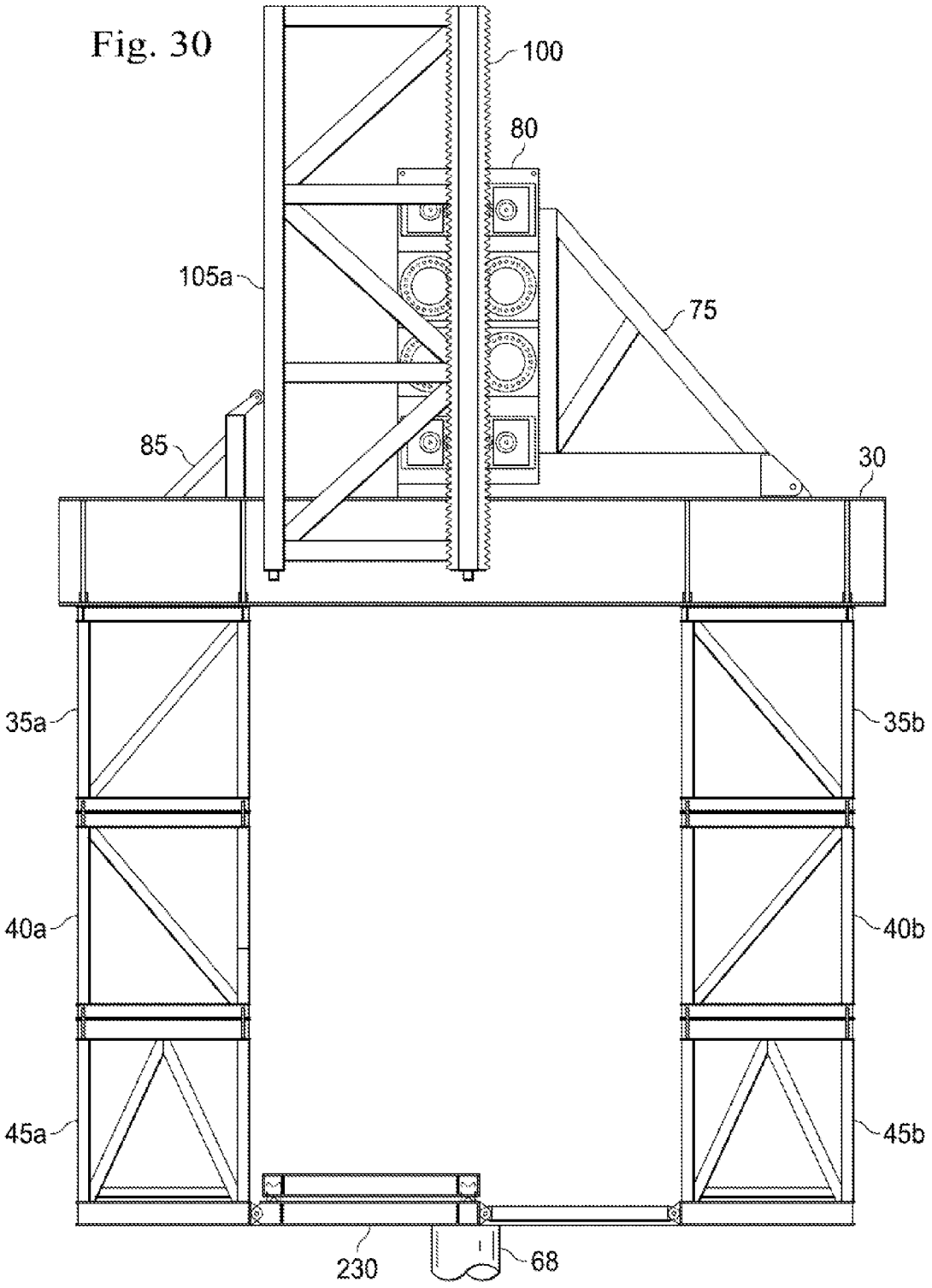

At step 375 and as shown in FIG. 30, the pinion drive carriage 80 is detached from the carriage frame 75 and travels vertically along the rack 100 of the mast section 105*a* to a second pinion drive carriage holding position. In one embodiment, the second pinion drive carriage holding position is a position at which the pinion drive carriage 80 operates for the remainder of the method 200. In one embodiment, the second pinion drive carriage holding position is associated with a height at which the upper portion of the pinion drive carriage 80 is attached to the upper portion of the carriage frame 75.

At step 380, the pinion drive carriage 80 is attached to the carriage frame 75 and the mast section 105*a* is detached from the rig floor 30. In one embodiment, the upper portion of the pinion drive carriage 80 is attached to the upper portion of the carriage frame 75.

In one embodiment, a method of constructing the platform includes steps 205, 210, 215, 240, 245, 250, 255, 260, 265, and 270.

In one embodiment, a method of constructing the mast 105 includes steps 220-235 and steps 275-350.

In another embodiment, a method of constructing the mast 105 include steps 220, 355-380, 235, and 275-350.

In another embodiment, additional sub boxes as required are attached to the lower sub boxes 45*a* and 45*b* in a manner similar to that which the lower sub boxes 45*a* and 45*b* are attached to the middle sub boxes 40*a* and 40*b* at step 265. In another embodiment, the platform is constructed using only the lower sub boxes 45*a* and 45*b* and the middle sub boxes 40*a* and 40*b*, the middle sub boxes 40*a* and 40*b* and the upper sub boxes 35*a* and 35*b*, or the lower sub boxes 45*a* and 45*b* and the upper sub boxes 35*a* and 35. In another embodiment, the platform is constructed using only the lower sub boxes 45*a* and 45*b*, the middle sub boxes 40*a* and 40*b*, or the upper sub boxes 35*a* and 35*b*.

The present disclosure introduces a method including attaching a carriage support to a platform, the platform comprising a platform floor having an opening therein, with the carriage support located proximate the opening; attaching a drive carriage to the carriage support; operably coupling to the drive carriage a first mast section of a mast comprising a plurality of mast sections, wherein the first mast section is located above the opening; arranging a second mast section below the first mast section; lowering, using the drive carriage, the first mast section through the opening; attaching the first mast section to the second mast section; and raising, using the drive carriage, the first mast section and the second mast section through the opening. In one aspect, the method also includes arranging a floor section below the second mast section; lowering, using the drive carriage, the first mast section and the second mast section through the opening; attaching the floor section to the second mast section; raising, using the drive carriage, the first mast section, the second mast section, and the floor section; and attaching the floor section to the platform floor. In one aspect, connecting the first mast section to the second mast section includes securing a lower portion of the first mast section and an upper portion of the second mast section together using a fastener. In one aspect, the drive carriage includes: a plurality of motors; and a plurality of pinions; wherein each pinion of the plurality of pinions is coupled to a respective motor of the plurality of motors; and wherein each pinion of the plurality of pinions is adapted to engage teeth located on a longitudinal edge of the first mast section and the second mast section. In one aspect, operably coupling the first mast section to the drive carriage includes engaging the teeth of the first mast section with the plurality of pinions of the drive carriage. In one aspect, actuation of one or more of the motors effects relative movement between the first mast section and the drive carriage. In one aspect, the opening is located above a wellbore. In one aspect, the floor section is attached to the platform floor using fasteners. In one aspect, the floor section includes a rotating system. In one aspect, the method also includes repeating the raising of an upper respective mast section, arranging of a lower respective mast section below the upper respective mast section, lowering of the upper respective mast section, and attaching of the upper and lower respective mast sections until the plurality of mast sections has been attached to form the mast.

The present disclosure also introduces a method including attaching a carriage support to a platform, the platform comprising a platform floor having an opening therein, with the carriage support located proximate the opening; operably coupling a first mast section of a mast to a drive carriage; arranging the first mast section and the drive carriage below the platform and the opening; raising the drive carriage to a first height; attaching the drive carriage to the carriage support; raising the first mast section, using the drive carriage, through the opening; attaching the first mast section to the platform floor; detaching the drive carriage from the carriage support; raising the drive carriage to a second height; detaching the first mast section from the platform floor; arranging a second mast section below the first mast section; lowering, using the drive carriage, the first mast section towards the second mast section; attaching the first mast section to the second mast section; and raising, using the drive carriage, the first mast section and the second mast section through the opening. In one aspect, the method also includes arranging a floor section below the second mast section; lowering, using the drive carriage, the first mast section and the second mast section towards the floor section; attaching the floor section to the second mast section; raising, using the drive carriage, the first mast section, the second mast section, and the floor section; and attaching the floor section to the platform. In one aspect, attaching the first mast section to the second mast section includes securing a lower portion of the first mast section and an upper portion of the second mast section together using a fastener. In one aspect, the drive carriage includes: a plurality of motors; and a plurality of pinions; wherein each pinion of the plurality of pinions is coupled to a respective motor of the plurality of motors; and wherein each pinion of the plurality of pinions is adapted to engage teeth located on a longitudinal edge of the first mast section and the second mast section. In one aspect, operably coupling the first mast section to the drive carriage includes engaging the teeth of the first mast section with the plurality of pinions of the drive carriage. In one aspect, actuation of the plurality of motors effects relative movement between the first mast section and the drive carriage. In one aspect, the opening is located above a wellbore. In one aspect, the floor section is attached to the platform using pins. In one aspect, the floor section includes a rotating system. In one aspect, the first height corresponds to a height at which an upper portion of the drive carriage attaches to a lower portion of the carriage support; wherein the second height corresponds to a height at which the upper portion of the drive carriage attaches to an upper portion of the carriage support; and wherein the second height is greater than the first height.

The present disclosure also describes an apparatus including a platform comprising a platform floor with an opening therein; a carriage support comprising a lower portion attached to the platform and an opposing upper portion, wherein the carriage support is located proximate the opening; and a drive carriage adapted to be attached to the carriage support; wherein the drive carriage includes: a plurality of motors; and a plurality of pinions; wherein each pinion of the plurality of pinions is coupled to a respective motor of the plurality of motors. In one aspect, the apparatus also includes a first mast section located below the platform floor, the first mast section extending along a first axis, the first mast section having a longitudinal edge with teeth located thereon; wherein each pinion of the plurality of pinions is adapted to engage the teeth of the first mast section and to operably couple the drive carriage to the first mast section; and wherein activation of the plurality of motors effects relative movement between the first mast section and the drive carriage along the first axis. In one aspect, the first mast section and the drive carriage are located below the platform floor and the opening; wherein the drive carriage is adapted to travel along the first axis towards the platform floor upon activation of the plurality of motors; wherein an upper portion of the drive carriage is adapted to be attached to the lower portion of the carriage support; wherein the first mast section is adapted to travel along the first axis upon activation of the plurality of motors; wherein the first mast section is adapted to attach to the platform; wherein the upper portion of the drive carriage is adapted to detach from the lower portion of the carriage support; wherein the drive carriage is adapted to travel along the first axis towards the upper portion of the carriage support; wherein the upper portion of the drive carriage is adapted to attach to the upper portion of the carriage support; and wherein the first mast section is adapted to detach from the platform. In one aspect, a second mast section is arranged below the first mast section; wherein the first mast section is adapted to be lowered along the first axis, upon activation of the plurality of motors, towards the second mast section; wherein the first mast section and the second mast section are configured to be attached; wherein the first mast section and the second mast section are adapted to travel upwards along the first axis, upon activation of the plurality of motors, and wherein the first axis is oriented at least substantially vertically. In one aspect, the second mast section includes a rotating system. In one aspect, the second mast section is adapted to be attached to the platform. In one aspect, the opening is located above a wellbore.

In several exemplary embodiments, the elements and teachings of the various illustrative exemplary embodiments may be combined in whole or in part in some or all of the illustrative exemplary embodiments. In addition, one or more of the elements and teachings of the various illustrative exemplary embodiments may be omitted, at least in part, and/or combined, at least in part, with one or more of the other elements and teachings of the various illustrative embodiments.

Any spatial references such as, for example, "upper," "lower," "above," "below," "between," "bottom," "vertical," "horizontal," "angular," "upwards," "downwards," "side-to-side," "left-to-right," "right-to-left," "top-to-bottom," "bottom-to-top," "top," "bottom," "bottom-up," "top-down," etc., are for the purpose of illustration only and do not limit the specific orientation or location of the structure described above.

In several exemplary embodiments, while different steps, processes, and procedures are described as appearing as distinct acts, one or more of the steps, one or more of the processes, and/or one or more of the procedures may also be performed in different orders, simultaneously and/or sequentially. In several exemplary embodiments, the steps, processes and/or procedures may be merged into one or more steps, processes and/or procedures.

In several exemplary embodiments, one or more of the operational steps in each embodiment may be omitted. Moreover, in some instances, some features of the present disclosure may be employed without a corresponding use of the other features. Moreover, one or more of the above-described embodiments and/or variations may be combined in whole or in part with any one or more of the other above-described embodiments and/or variations.

Although several exemplary embodiments have been described in detail above, the embodiments described are exemplary only and are not limiting, and those skilled in the art will readily appreciate that many other modifications, changes and/or substitutions are possible in the exemplary embodiments without materially departing from the novel teachings and advantages of the present disclosure. Accordingly, all such modifications, changes and/or substitutions are intended to be included within the scope of this disclosure as defined in the following claims. In the claims, any means-plus-function clauses are intended to cover the structures described herein as performing the recited function and not only structural equivalents, but also equivalent structures.

The foregoing outlines features of several embodiments so that a person of ordinary skill in the art may better understand the aspects of the present disclosure. Such features may be replaced by any one of numerous equivalent alternatives, only some of which are disclosed herein. One of ordinary skill in the art should appreciate that they may readily use the present disclosure as a basis for designing or modifying other processes and structures for carrying out the same purposes and/or achieving the same advantages of the embodiments introduced herein. One of ordinary skill in the art should also realize that such equivalent constructions do not depart from the spirit and scope of the present disclosure, and that they may make various changes, substitutions and alterations herein without departing from the spirit and scope of the present disclosure.

The Abstract at the end of this disclosure is provided to comply with 37 C.F.R. §1.72(b) to allow the reader to quickly ascertain the nature of the technical disclosure. It is submitted with the understanding that it will not be used to interpret or limit the scope or meaning of the claims.

Moreover, it is the express intention of the applicant not to invoke 35 U.S.C. §112, paragraph 6 for any limitations of any of the claims herein, except for those in which the claim expressly uses the word "means" together with an associated function.

What is claimed is:

1. An apparatus comprising:

a platform comprising a platform floor with an opening therein;

a carriage support comprising a lower portion attached to the platform and an opposing, upper portion, wherein the carriage support is located proximate the opening; and a drive carriage adapted to be attached to the carriage support, wherein the drive carriage comprises:

a plurality of motors; and a plurality of pinions, wherein each pinion of the plurality of pinions is coupled to a respective motor of the plurality of motors; and a first mast section located below the platform floor, the first mast section extending alone a first axis, the first mast section having a longitudinal edge with teeth located thereon, being adapted to travel along the first axis upon activation of the plurality of motors, and being adapted to attach to and detach from the platform, wherein each pinion of the plurality of pinions is adapted to engage the teeth of the first mast section and to operably couple the drive carriage to the first mast section, wherein activation of the plurality of motors effects relative movement between the first mast section and the drive carriage along the first axis; and wherein the first mast section and the drive carriage are located below the platform floor and the opening, wherein the drive carriage is adapted to travel along the first axis towards the platform floor upon activation of the plurality of motors and towards the upper portion of the carriage support, wherein an upper portion of the drive carriage is adapted to be attached to and detach from the lower portion of the carriage support, and to be attached to the upper portion of the carriage support.

2. The apparatus of claim 1, wherein a second mast section is arranged below the first mast section, wherein the first mast section is adapted to be lowered along the first axis, upon activation of the plurality of motors, towards the second mast section, wherein the first mast section and the second mast section are configured to be attached, wherein the first mast section and the second mast section are adapted to travel upwards along the first axis, upon activation of the plurality of motors, and wherein the first axis is oriented at least substantially vertically.

3. The apparatus of claim 2, wherein the second mast section comprises a rotating system.

4. The apparatus of claim 2, wherein the second mast section is adapted to be attached to the platform.

5. The apparatus of claim 1, wherein the opening is located above a wellbore.

6. A method, comprising:

attaching a carriage support to a platform, the platform comprising a platform floor having an opening therein, with the carriage support located proximate the opening;

operably coupling a first mast section of a mast to a drive carriage;

arranging the first mast section and the drive carriage below the platform and the opening;

raising the drive carriage to a first height;

attaching the drive carriage to the carriage support;

raising the first mast section, using the drive carriage, through the opening;

attaching the first mast section to the platform floor;

detaching the drive carriage from the carriage support;

raising the drive carriage to a second height;

detaching the first mast section from the platform floor;

arranging a second mast section below the first mast section;

lowering, using the drive carriage, the first mast section towards the second mast section;

attaching the first mast section to the second mast section; and raising, using the drive carriage, the first mast section and the second mast section through the opening.

7. The method of claim 6 which further comprises:

arranging a floor section below the second mast section;

lowering, using the drive carriage, the first mast section and the second mast section towards the floor section;

attaching the floor section to the second mast section;

raising, using the drive carriage, the first mast section, the second mast section, and the floor section; and attaching the floor section to the platform.

8. The method of claim 6, wherein attaching the first mast section to the second mast section comprises securing a lower portion of the first mast section and an upper portion of the second mast section together using a fastener.

9. The method of claim 6, wherein the drive carriage comprises:

a plurality of motors; and a plurality of pinions, wherein each pinion of the plurality of pinions is coupled to a respective motor of the plurality of motors, and wherein each pinion of the plurality of pinions is adapted to engage teeth located on a longitudinal edge of the first mast section and the second mast section.

10. The method of claim 9, wherein operably coupling the first mast section to the drive carriage comprises engaging the teeth of the first mast section with the plurality of pinions of the drive carriage.

11. The method of claim 10, wherein actuation of the plurality of motors effects relative movement between the first mast section and the drive carriage.

12. The method of claim 6, wherein the opening is located above a wellbore.

13. The method of claim 6, wherein the floor section is attached to the platform using pins.

14. The method of claim 7, wherein the floor section comprises a rotating system.

15. The method of claim 6, wherein the first height corresponds to a height at which an upper portion of the drive carriage attaches to a lower portion of the carriage support, wherein the second height corresponds to a height at which the upper portion of the drive carriage attaches to an upper portion of the carriage support, and wherein the second height is greater than the first height.

* * * * *